US005933175A

United States Patent [19]

Stathem et al.

[11] Patent Number: 5,933,175

[45] Date of Patent: Aug. 3, 1999

[54] BOTTOM FILL INKJET CARTRIDGE THROUGH BUBBLE GENERATOR

[75] Inventors: Ralph L. Stathem, Lebanon; John B. R. Dunn, Corvallis; Sandra J. Smith, Corvallis; Christopher P. Murschel, Corvallis; Lowell R. McDaniel, Corvallis; David L. Erickson, Corvallis; Kevin D. Almen, Albany; Peter R. Stokes, Corvallis; Wayne J. Traina, Albany, all of Oreg.

[73] Assignee: Hewlett-Packard Company, Palo Alto, Calif.

[21] Appl. No.: 08/692,349

[22] Filed: Aug. 5, 1996

[51] Int. Cl.[6] ..... B41J 2/175

[52] U.S. Cl. ..... 347/87

[58] Field of Search ..... 347/85, 86, 87

[56] References Cited

U.S. PATENT DOCUMENTS

| | | | |
|---|---|---|---|
| 4,920,362 | 4/1990 | Cowger . | |
| 4,992,802 | 2/1991 | Dion et al. . | |
| 5,103,243 | 4/1992 | Cowger . | |
| 5,121,132 | 6/1992 | Pan et al. . | |
| 5,153,612 | 10/1992 | Dunn et al. . | |
| 5,168,285 | 12/1992 | Winslow . | |
| 5,199,470 | 4/1993 | Goldman | 141/1 |
| 5,329,294 | 7/1994 | Ontawar et al. | 397/87 |
| 5,341,160 | 8/1994 | Winslow et al. . | |
| 5,363,130 | 11/1994 | Cowger et al. . | |
| 5,409,134 | 4/1995 | Cowger et al. . | |
| 5,526,030 | 6/1996 | Baldwin et al. | 347/87 |
| 5,537,134 | 7/1996 | Baldwin et al. | 347/85 |
| 5,704,403 | 1/1998 | Schwenk et al. | 141/18 |

OTHER PUBLICATIONS

Cowger, B., "The Optimization of Deliverable Ink from a Disposable Print Cartridge;" IS&T's Eigth Int'l Congress on Non–Impact Printing Technologies (1992).

*Primary Examiner*—N. Le
*Assistant Examiner*—Michael Nghiem

[57] ABSTRACT

A disposable/refillable inkjet cartridge with bubble generator and an adhesively attached bubble generator vent cover. The cartridge is filed through a bubble generator opening in the cartridge bottom eliminating a separate filling orifice and easing the priming operation. The vent cover is adhesively attached making removal for refilling easier and avoiding suspected problems related to welding flash in welded vent covers. The bubble generator includes a tapered opening which receives a ball. The ball contacts ribs extending longitudinally along a tapered portion of the opening. The ribs are spaced over an arc of the opening. A bubble forms as needed between the ball and opening to maintain back pressure. The ribs and taper produce more consistent bubble pressures. A single piece of tape over the bubble generator and printhead nozzles avoids common causes for depriming.

6 Claims, 3 Drawing Sheets

FIG. 3
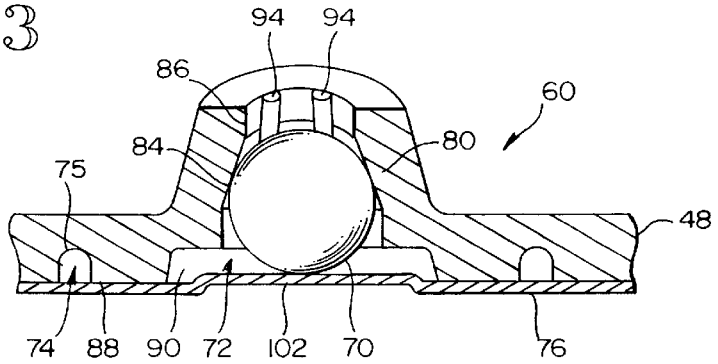
FIG. 4
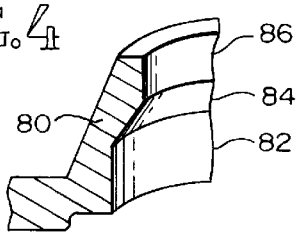
FIG. 5
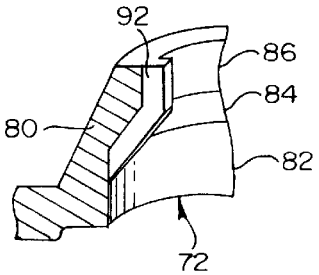
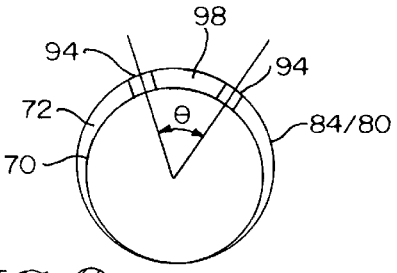
FIG. 6
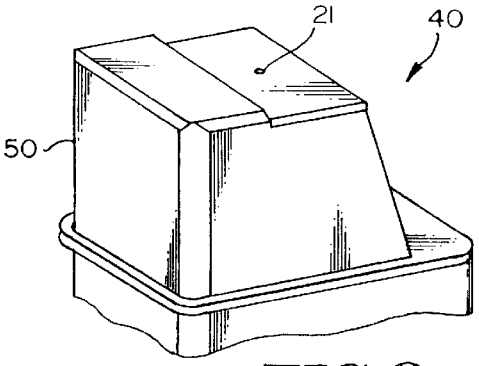
FIG. 8
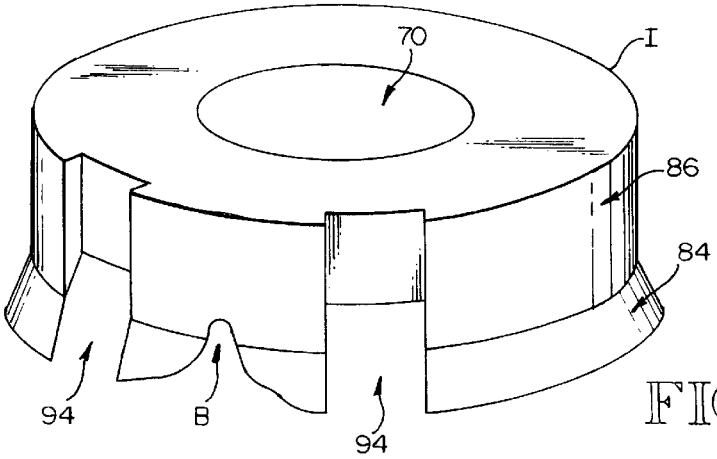
FIG. 7

FIG. 9
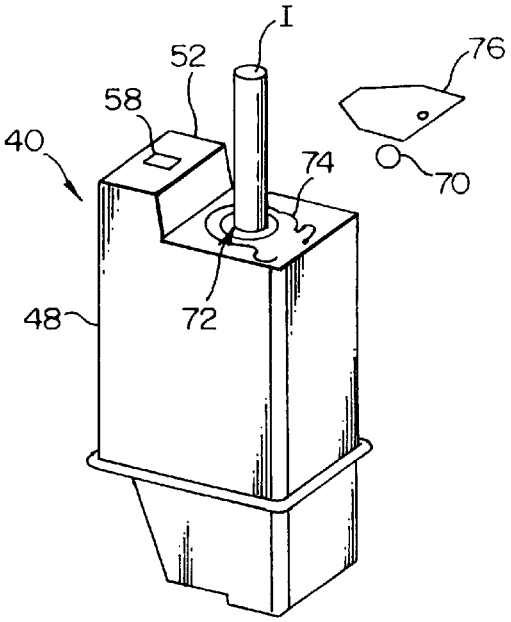
FIG. 10
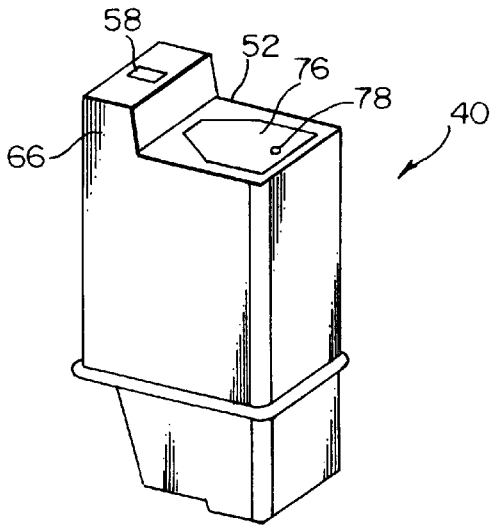
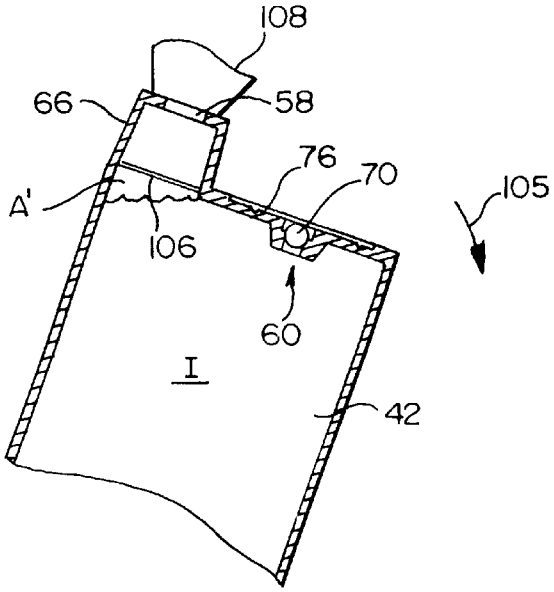
FIG. 11
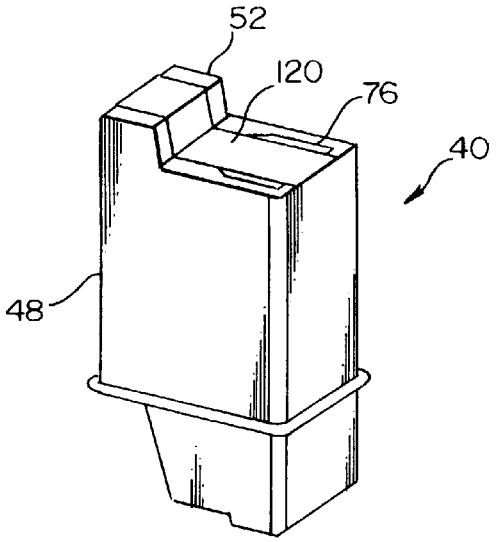
FIG. 12

BOTTOM FILL INKJET CARTRIDGE THROUGH BUBBLE GENERATOR

BACKGROUND OF THE INVENTION

This invention relates generally to disposable and refillable inkjet printing cartridges, and more particularly to a bubble generator and vent cover for an inkjet cartridge and a method for filling an inkjet cartridge.

Inkjet printing generally involves the controlled delivery of ink drops from an inkjet cartridge reservoir to a printing surface. One type of inkjet printing, known as drop-on-demand printing, employs a pen that has a print head responsive to control signals for ejecting ink drops from the reservoir. Drop-on -demand type printheads typically use one of two mechanisms for ejecting drops: thermal bubble or piezoelectric pressure wave. A thermal bubble type printhead includes a thin-film resistor that is heated to cause sudden evaporization of a small portion of ink within an inkjet nozzle. The rapid expansion of the ink vapor forces a small amount of ink through the nozzle's orifice. Piezoelectric pressure wave type printheads use a piezoelectric element responsive to a control signal for abruptly compressing a volume of ink within a nozzle. A resulting pressure wave forces the ink through the nozzle orifice.

The drop-on-demand printhead is effective for ejecting or "pumping" ink drops from a cartridge's ink reservoir. When the printhead is inactive, there is need to prevent ink from permeating (or leaking) through the printhead. To prevent such occurrence it is preferred to create a slight back pressure at the printhead when inactive to prevent leakage. The term "back pressure", as used herein, means the partial vacuum within an inkjet reservoir that resists flow of ink through the printhead. Back pressure is considered in the positive sense so that an increase in back pressure represents an increase in partial vacuum. Accordingly, back pressure is measured in positive terms, such as water column height.

It is desired that the back pressure at the printhead be at all times strong enough to prevent ink leakage. The back pressure, however, is not to be so strong that the printhead is unable to overcome the back pressure to eject ink drops. Moreover, it is desired that the inkjet cartridge be designed to operate despite environment changes causing fluctuations in back pressure.

A severe environmental change that affects reservoir back pressure occurs during air transport of an inkjet cartridge. In such instance, ambient air pressure decreases as an aircraft gains altitude and is depressurized. As ambient air pressure decreases, the pressure differential between the environment and the reservoir decreases. To maintain the pressure differential, back pressure needs to be increased (i.e., make more negative) to keep ink from leaking through the printhead. Accordingly, the level of back pressure is regulated during times of ambient pressure drop.

Changes in back pressure also occur during operation. As the printhead ejects an ink drop, the depletion of ink from the reservoir increases the reservoir back pressure (i.e., makes more negative; creates greater vacuum). Without regulation of the back pressure, the inkjet cartridge eventually will fail prior to using all the ink in the reservoir. Specifically, the inkjet printhead is unable to overcome the increased back pressure to eject ink drops.

Mechanisms for regulating inkjet reservoir back pressure dynamics in response to environmental changes and operational effects include mechanisms commonly referred to as accumulators. The accumulators are designed to move between a minimum volume position and a maximum volume position in response to changes in the level of the back pressure within the reservoir. Accumulator movement changes the overall volume of the reservoir to regulate the back pressure to maintain back pressure within desired operating range.

For example, the accumulator increases reservoir volume as the difference between ambient pressure and back pressure decreases. This increases back pressure sufficiently to avoid leakage. In effect the increase in back pressure caused by the accumulator counters the decrease in the difference between ambient pressure and back pressure. Thus, a reliable difference between ambient pressure and back pressure is maintained to avoid leakage.

The accumulator decreases reservoir volume when environmental changes or operational effects (e.g., ink depletion) cause an increase in back pressure. The decreased volume decreases back pressure sufficiently to avoid printhead failure. In effect the decrease in back pressure caused by the accumulator counters the increase in the difference between ambient pressure and back pressure. Thus, a reliable difference between ambient pressure and back pressure is maintained to avoid printhead failure.

Accumulators have been used in conjunction with devices referred to as bubble generators. A conventional bubble generator permits ambient air bubbles to enter the ink reservoir once the accumulator has moved to its maximum volume position (that is, once the accumulator is unable to further reduce back pressure) and back pressure continues to increase. Air bubbles delivered by the bubble generator increase the air volume in the ink reservoir in an effort to prevent back pressure from reaching a level causing printhead failure. Bubble generators generally include an air inlet passage and a small-diameter orifice that provides communication between the bubble generator and ambient air. The reservoir back pressure maintained by the accumulator prevents ink from leaking through the bubble generator orifice. With the reservoir being positioned over the bubble generator orifice, ambient air is unable to enter the reservoir and alter the back pressure until back pressure increases enough to draw an air bubble through the orifice into the reservoir.

One problem addressed by the invention is that variations in inkjet cartridge part dimension due to manufacturing tolerances or changes in ambient temperature cause variations in bubble pressure at the bubble generator. Such variations in bubble pressure in turn affect print quality and inkjet cartridge performance. Accordingly, there is need for a bubble generator which produces more consistent bubble pressures across changes in ambient temperature and pressure.

Another problem addressed by this invention is related to the welding of a vent cover over the bubble generator. Conventional inkjet cartridges include a welded vent cover having an opening leading to the bubble generator. Flash or very small pockets in the welding have been observed to occur between the cover and the area of the cartridge being covered. During specific pressure changes, ink is suspected of wicking through the bubble generator into the flash and pockets. Eventually the ink dries into a porous patch. Such porous patch is more prone to drawing ink during pressure changes and can result in less effective vent inlet performance for the bubble generator. As a result, there is a need for a more reliable method for attaching the vent cover.

Additional problems addressed by this invention relate to the difficulty in priming an inkjet cartridge and the susceptibility toward depriming of the inkjet cartridge. A conventional inkjet cartridge 10 (see FIG. 1) includes a casing 12 with an internal ink reservoir 13. For purposes of naming consistency a bottom surface 14 of the casing refers to a bottom surface in the cartridge's installed ready-to-print position. A printhead 16 typically is at a most bottom portion of the case. The bubble generator 18 also is located along a bottom surface of the case. A vent cover 19 covers the bubble generator. The accumulator 20 is located within the reservoir. There is an opening 21 in a top surface of the case proving a vent to accumulator 20 air bags. Typically there is another opening 22 in the top surface of the case through which ink is poured to fill the reservoir. A plug 24 blocks the opening once the ink is loaded. The opening 22 remains plugged during operation. Once the ink is loaded and the opening is plugged, the cartridge is to be primed. Priming is performed to remove air from the printhead region and to initially draw the ink into the printhead nozzles. Priming is achieved by sucking air through the printhead nozzles thereby drawing ink from the reservoir into the printhead.

Prior to ink fill, a piece of tape is placed over the bubble generator vent to prevent leakage during filling. Once filled and after priming, another piece of tape is placed over the nozzles. The two pieces of tape prevent drooling and clogging of the openings during shipment. Upon shipment an end user removes the tapes allowing operation of the cartridge. Failure to remove the nozzle tape precludes ink ejection and is quickly remedied by the user. Failure to remove the bubble generator tape, however, has no immediate effect. Thus, it is less evident to an end user that the cartridge has been incorrectly placed into service. Specifically, if the tape over the bubble generator vent is not removed, the cartridge eventually will deprime before most of the ink is consumed. Depriming is caused by lack of back pressure regulation. Once enough ink has been consumed that the accumulator is no longer able to regulate back pressure and the bubble generator is supposed take over, failure of the bubble generator to take over causes an increase in back pressure and eventually air intake and depriming through the nozzle orifices. Once deprimed, the cartridge ceases to eject ink droplets even though there is still a substantial amount of ink in the reservoir. Typically, an end user does not have the equipment to reprime the cartridge. Thus, for the disposable cartridge the useful life of the cartridge is substantially shortened by a user's failure to remove the tape over the bubble generator vent. Accordingly there is need for an improved fail-safe to avoid depriming.

SUMMARY OF THE INVENTION

According to the invention, a bottom fill disposable/refillable inkjet cartridge is provided, including an improved bubble generator and an adhesively attached bubble generator vent cover. A single piece of tape covers printhead nozzles and a vent cover opening during shipment. The cartridge includes an internal reservoir for storing ink, an accumulator within the reservoir, a printhead receiving ink for ejection through printhead nozzles, and a bubble generator. The accumulator and bubble generator serve as a back pressure regulator.

According to one aspect of the invention, the inkjet cartridge is integrally sealed having no openings communicating environmental pressure to the reservoir inside of the cartridge, other than through printhead nozzle orifices and the bubble generator vent. More specifically, there is no opening along a top surface for filling the reservoir with ink. Instead, the reservoir is filled through the bubble generator prior to installation of the bubble generator vent cover and internal components. (The top surface, however, in some embodiments has a vent opening to accumulator air bags within the reservoir. Such vent is not in communication with an ink area of the reservoir.)

According to another aspect of the invention, the inkjet cartridge is filled by turning the cartridge upside down, so as to position the printhead and bubble generator at an upper position. Ink is poured into the reservoir through the bubble generator. The bubble generator vent cover then is attached and the cartridge is primed. The cartridge is now ready for operation.

There are several advantages achieved by filling the cartridge from the bottom rather than from the top. One advantage is that the cartridge is effectively tested for leaks before ink is loaded. During such testing the only openings to the ink reservoir are at the printhead nozzles, and the bubble generator. These openings are temporarily sealed during testing. Contrast this cartridge to a top-fill cartridge which has a plug installed after the ink is loaded. The top-fill cartridge also is tested before ink is loaded. However, the opening for the plug is present. Thus, once the plug is installed there is another potential failure point present which cannot be economically or effectively tested.

Another advantage of filling the cartridge from the bottom is that ink is more evenly distributed within the reservoir. The accumulator within the reservoir includes multiple bags surrounded by ink. During a top-filling process, ink tends to fill unevenly being at times analogous to the filling of an ice cube tray where one portion is filled until the ink/water spills over to the next portion to fill such other portion.

Another advantage of bottom filling the inkjet cartridge is related to the priming process. The inkjet cartridge includes a standpipe area connecting the printhead to the main reservoir area. A screen separates the standpipe area from the main reservoir area. When filling the cartridge from the top, ink travels down toward the screen and standpipe. As a result the screen gets wet with ink during filling. As a result, there is more resistance and foaming at the screen when sucking air from the cartridge (i.e., priming the cartridge) through the printhead nozzles. For a bottom fill cartridge it was discovered that priming is most effective when the cartridge standpipe area has no ink or only ink. According to an aspect of this invention, priming is performed using a process in which no ink is on the screen or in the standpipe area before priming.

According to another aspect of this invention, when filling the bottom fill ink cartridge the screen separating the standpipe from the reservoir remains dry. Thus, when priming the cartridge, there is relatively less resistance and foaming at the screen. This eases the priming operation allowing air trapped in the standpipe to be more readily removed through the nozzles.

According to another aspect of the invention, a single piece of tape or covering is applied over the printhead nozzles and bubble generator vent after priming. This prevents a user from inadvertently placing the cartridge into service with the bubble generator vent closed. A beneficial effect of such single covering is that one cause of depriming (i.e., leaving bubble generator vent covered) is avoided.

According to another aspect of the invention, the bubble generator is improved to provide a more consistent bubble pressure, and thus to maintain a more consistent back pressure. The bubble generator is formed as a cylindrical bore-like opening in the cartridge case. The bubble generator is defined by a tapered neck section. A plurality of ribs extend longitudinally along the tapered neck section. A spherical ball is loaded into the neck section against the ribs. In one embodiment the ribs are equally spaced about the perimeter of the neck section. In another embodiment the ribs are located toward one region of the neck spanning an arc less than 180°. Portions of the ball rest on the ribs. Another portion of the ball rests against a surface of the tapered neck section. In preferred embodiments the neck section of interest tapers at 5° to 75°. In one embodiment two ribs are spaced at ends of a 20° to 90° arc of the cylindrical neck section. The air space between the ball and neck portion spanning the arc between the ribs defines a region at which an air bubble forms. By tapering the neck portion, the area at which the air bubble forms is effectively defined even in the presence of slight variations in ball diameter, neck diameter, and concentricity of the ball to the taper within the neck section. Specifically the bubble formation is less sensitive to manufacturing tolerances resulting in more consistent bubble pressures.

According to another aspect of the invention, the ball is preloaded into the bubble generator by the bubble generator cover biasing the ball toward the tapered neck section. In some embodiments the cover includes an indent, dimple or other interfering structure for biasing the ball.

According to another aspect of the invention, the bubble generator cover is secured by an adhesive rather than by welding. One advantage of the adhesive is that welding flaws (e.g., flash or pockets) are avoided. Another advantage is that the cover is removable without damaging the cartridge. The cover includes a vent opening at the end of a labyrinth passageway to the cylindrical opening and tapered neck section.

According to another aspect of the invention, the inkjet cartridge is refilled by removing the bubble generator cover and removing the ball so as to define an open path to the reservoir. Ink is poured into the reservoir through the bubble generator's cylindrical opening. The ball then is re-inserted, and the same cover re-applied or a new cover adhesively attached. Next the accumulator air bags are preloaded. In some instances the cartridge then is ready for use. In other instances the cartridge also is reprimed, then ready for use. If the cartridge is to be shipped before use, a single tape covering is applied over the printhead nozzles and bubble generator vent opening.

These and other aspects and advantages of the invention will be better understood by reference to the following detailed description taken in conjunction with the accompanying drawings.

BRIEF DESCRIPTION OF THE DRAWINGS

FIG. 3 is a partial cut-away view showing the bubble generator of FIG. 2;

FIG. 4 is a partial cross-sectional view of a surface defining a cylindrical opening for the bubble generator of FIG. 2;

FIG. 5 is another partial cross-sectional view showing a rib formed along the surface and opening of FIG. 2;

FIG. 6 is a diagram of the bubble generator opening, ribs, and ball of FIG. 2;

FIG. 7 is a perspective view of ink as contoured within the bubble generator of FIG. 2;

FIG. 8 is a partial perspective view of an upper portion of the inkjet cartridge of FIG. 2;

FIG. 9 is a perspective view of the inkjet cartridge of FIG. 2 in the process of being filled with ink;

FIG. 10 is a perspective view of the inkjet cartridge of FIG. 9 after being filled with ink;

FIG. 11 is a partial planar view of the inkjet cartridge of FIG. 10 rotated into position for priming its printhead; and FIG. 12 is a perspective view of the inkjet cartridge of FIG. 2 with tape applied and ready for shipping.

DESCRIPTION OF SPECIFIC EMBODIMENTS

Figure 1:
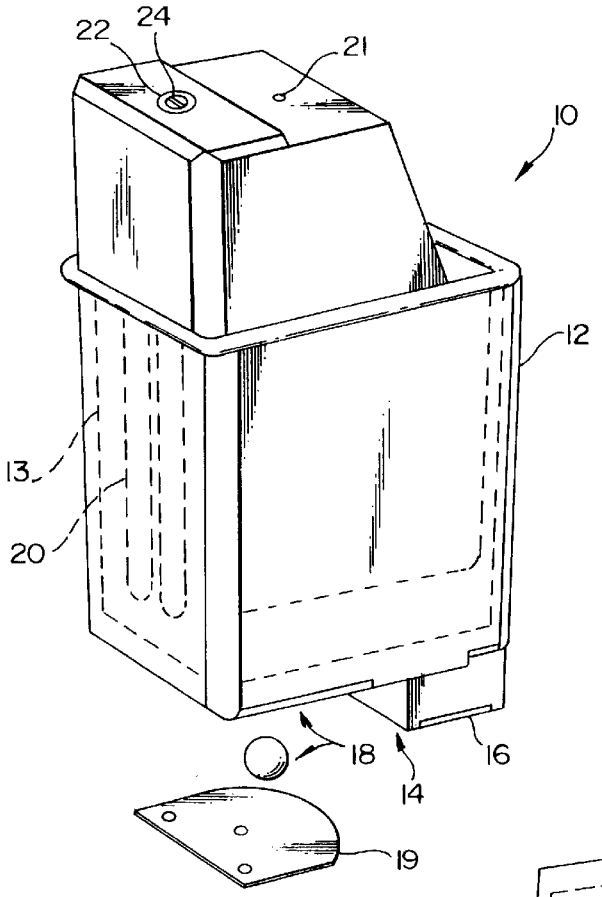
FIG. 1 PRIOR ART
FIG.1 is a perspective view of a conventional top-fill inkjet printing cartridge.
Figure 2:
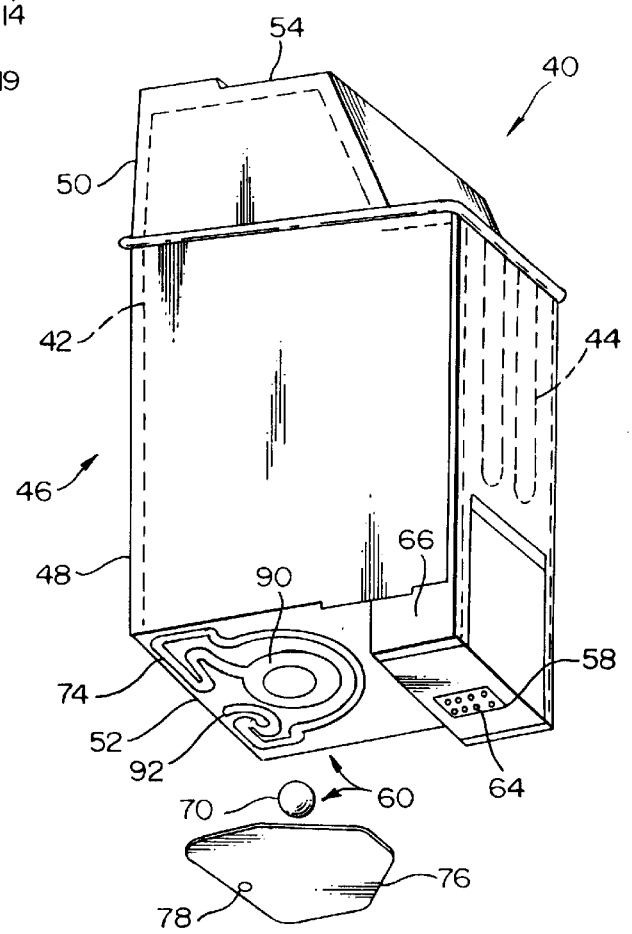
FIG. 2 is a perspective partially-exploded view of a bottom-fill inkjet printing cartridge according to one embodiment of this invention.

FIG. 2 shows a bottom-fill inkjet printing cartridge 40 according to an embodiment of this invention. The cartridge 40 includes an internal reservoir 42 for storing ink and an accumulator 44 (shown in phantom view) for regulating back pressure. The cartridge 40 has an outer case 46 formed by a main body 48 and cap 50. In some embodiments the case 46 is a one-piece integral structure. With the cartridge 40 oriented as installed and ready for operation the cartridge has a bottom 52 and a top 54. A drop-on-demand type inkjet printhead 58 and a bubble generator 60 are formed at the bottom 52. The printhead 58 includes a plurality of inkjet nozzles 64 through which ink is ejected. Ink is received into nozzle chambers via capillary action from the reservoir 42 via a standpipe section 66. While the ink reservoir 42 has more than a threshold amount of ink stored, the accumulator 44 maintains a consistent back pressure within the cartridge 40 during operation and storage. When the ink level falls below the threshold amount, a pressure differential between the internal pressure and the external environment causes air bubbles to form through the bubble generator 60 to continue maintaining a consistent back pressure during operation.

Bubble Generator

The bubble generator 60 is formed by a spherical ball 70 received into a cylindrical opening 72 (FIG. 3) in the cartridge bottom 52. Also defining a part of the bubble generator 60 is a labyrinth passageway 74. The passageway 74 is defined by a groove 75 (FIG. 3) in the cartridge bottom 52 as covered with a bubble generator cover 76. The cover 76 defines a vent opening 78 in communication with the passageway 74. An air path is formed through the bubble generator 60 into the reservoir 42 via the vent opening 78, passageway 74 and a spacing between the ball 70 and the cylindrical opening 72.

FIG. 3 shows a portion of the bubble generator 60 with the ball 70 inserted into the cylindrical opening 72. The cylindrical opening 72 is defined by a first surface 80 of the case 48. The opening 72 is defined in one or more sections. Shown in FIGS. 3–5 is an embodiment having three sections 82, 84, 86. A first section 82 closest to the cover 76 extends substantially perpendicular to a plane defined by the cover 76. The second section 84 tapers at preferably between 5° and 75°. In one embodiment a 15° taper is present. The third section 86 like section 82 extends substantially perpendicular to the plane defined by the cover 76. In an alternative embodiment the sections 82, 86 also are tapered, although at a different angle. For example, in a preferred embodiment either one or both of sections 82, 86 are tapered at an angle of not more than 5°. In an alternative embodiment the cylindrical opening 72 is formed by one section having a constant taper along its entire length. In another embodiment there are only two section either one or both being tapered. In one embodiment the opening has the following diameters: section 82—4.33 mm; section 84—4.26 mm at one end, 3.73 mm at other end; section 86—3.64 mm. Ball 70 has a diameter of 4.00 mm.

Referring to FIGS. 2 and 3, a groove 75 is formed in a second surface 88 of the case 48. The groove 75 begins at a recessed area 90 concentric to the cylindrical opening 72 and extends to an end position 92. The vent cover 76 defines an opening 78 which aligns with the groove endpoint 92. The groove 75 as covered by the vent cover 76 defines the passageway 29 mm. The passageway 74 communicates the external environment to the opening 72. In one embodiment the groove 75 is 29 mm long and has a cross-sectional diameter of approximately 0.38 $mm^2$. In a preferred embodiment the passageway 74 occurs over a winding pathway, referred to herein as a labyrinth. The labyrinth provides an elongated pathway separating the ink reservoir from the external environment. The long length of the labyrinth provides a very low humidity gradient which slows the loss of water vapor from the reservoir to the atmosphere by evaporation.

FIGS. 3 and 5 show the presence of ribs 94 along the surface 80 within the cylindrical opening 72. The ribs 94 extend from the third section 86 along the second section 84 to the first section 82. Preferably the ribs 94 do not extend along section 82 to an edge of section 82 at the cover 76. In the embodiment shown the ribs merely continue at the taper angle of the second section 84 until becoming flush with surface 80 at the first section 82. Because the lines where the ribs 94 meet the surface 80 define paths of least resistance to ink flow, it is preferred to avoid extending the ribs to the cover 76. This reduces wicking of the ink through the bubble generator opening 72. In one embodiment the ribs have a height of 0.08 mm and are spaced over an arc of 60 degrees.

In a best mode embodiment the ribs 94 occur over not more than a 180° arc of the opening 72. In an embodiment shown in FIG. 6 two ribs 94 are spaced along an arc θ between 30° and 120°. By using two ribs 94 spaced at an angle less than a 180° arc (and preferably spaced at a 30° to 120° arc), the ball 70 is biased to a position against both ribs 94. In one embodiment ball 70 is formed of stainless steel or glass. Even with variations in ball diameter, opening 72 diameter, or rib height due to manufacturing tolerances, the tapering along section 84 allows the ball 70 to rest against the tapered second section 84 over a portion of the ball circumference and against the ribs 94 along the second section 84 of the opening 72 over another portion of the ball circumference. As a result a reliably-sized area 98 occurs between the ball 70 and second section 84 between the ribs 94.

In one embodiment the bubble generator 60 is designed to form a bubble when the back pressure becomes equivalent to a 5 inch water column. It is believed that a bubble of approximately 0.005 to 0.007 cc forms in the matter of a few milliseconds at such back pressure. Ink from the reservoir 42 is in communication with the third section 86 of the bubble generator opening 72. FIG. 7 shows a view of ink I in the opening 72. The ink reaches down into the third section 86 and the second section 84, but is restricted from dribbling out the opening 72 into the passageway 74 by the ball 70. With only a small partial annulus of communication between the ink and air (see spacing between ball 70 and wall 80 in FIG. 6) the ink surface tension relative to the area of communication keeps the ink in the cartridge. Once the ink level lowers to the point where the accumulator is unable to maintain a consistent back pressure, a pressure differential between the air pressure in the opening 72 and the ink in the opening 72 occurs in response to ejection of ink through the printhead nozzles 64. Referring to FIG. 7, each time the printhead ejects enough ink to lower the pressure inside the reservoir 42 beyond a threshold pressure, referred to herein as the bubble pressure, an air bubble B is sucked into the reservoir 42 via spacing 98 of opening 72. The air bubble B is formed when the liquid pressure of the ink I is sufficiently lower than the air pressure in opening 72 to provide the energy needed to create a new interfacial surface for the resulting air bubble. The air bubble buoys up to the top of the reservoir joining other air. The occasional air bubble lowers the back pressure so as to maintain a consistent back pressure within the reservoir 42. The bubble pressure at which air is admitted is inversely related to the spacing 98 area and is directly related to the surface tension of the ink I. By implementing a tapered surface at section 84 in which the ball rests against such tapered section, a reliable spacing 98 area is achieved.

Bubble Generator Vent Cover

FIGS. 2 and 3 show the bubble generator vent cover 76. The cover 76 fits over the ball 70, opening 72 and groove 75. As shown in FIG. 3, in one embodiment the cover 76 includes a dimpled section 102 for preloading the ball 70 against the ribs 94 and tapered section 84. In another embodiment the cover 76 is flat and has a portion deflected at assembly time to preload the ball 70. The dimple 102, or other preloading structure assures that even in the presence of dimension variation due to manufacturing tolerances the ball 70 is maintained in contact with the ribs 94 and second section 84. The cover 76 includes a vent opening 78 adjacent to one end of the passageway 74 defined by the groove 75 and cover 76.

According to one aspect of this invention, the cover 76 is adhesively attached to the cartridge bottom 52. Prior cartridges had the cover 76 welded to the bottom 52. One advantage of adhesively attaching the cover 76 is that welding flaws (e.g., flash, pockets), and suspected bubble generator performance problems related to ink build-up at the welding flash, are avoided. Another advantage is that the cover is removable without damaging the cartridge. In one embodiment the cover is formed of plastic and an adhesive is formed of an acrylic material.

Methods for Filling and Refilling Cartridge

According to one aspect of the invention, an inkjet cartridge is filled from the bottom through the bubble generator 60. FIG. 2 shows a bottom fill inkjet cartridge 40 according to one embodiment. FIG. 8 shows an upper portion of the cartridge 40. The upper portion 50 includes a vent opening 21 to the accumulator, but no openings to the ink chamber. Contrast this to the conventional cartridge 10 shown in FIG. I in which an additional opening 22 is formed in the top through which the cartridge 10 is filled with ink. In a preferred embodiment bottom-fill inkjet cartridge 40 includes no openings to the external environment other than the nozzles 64 orifices and the bubble generator 60 (e.g., pathway from cover opening 78, passageway 74 and opening 72). One advantage of such a cartridge is that the cartridge 40 is effectively tested for leaks before ink is loaded. During such testing the openings at the printhead nozzles are temporarily sealed. Leak testing occurs via access through the bubble generator. Contrast this to a top-fill cartridge which has a plug installed after the ink is loaded. The top-fill cartridge also is tested before ink is loaded. However, the opening for the plug is present. Thus, once the plug is installed there is another potential failure point present which has to be separately tested. This separate testing does not have the same sensitivity as the testing prior to ink filling. For the inventive embodiment, the bubble generator opening is not supposed to be air tight. Thus it need not be tested to the same sensitivity as testing prior to ink filling.

FIG. 9 shows the bottom-fill inkjet cartridge 40 with the cover 76 and ball 70 removed. The cartridge 40 is turned so that the bottom 52 is face up exposing the opening 72. With the cover 76 and ball 70 removed, the opening 72 defines an unobstructed direct channel into the reservoir 42. Ink I is poured into the reservoir 42 through the opening 72. Preferably the bottom 52 is at least turned away from a downward orientation to allow ink to be inserted through opening 72 without falling back out such opening.

Once a desired amount of ink is filled into the reservoir 42, the bottom 52 is wiped clean of ink. The ball 70 then is inserted into the opening 72 and the cover 76 is adhesively attached to the bottom 52 aligning the vent opening 78 to the groove endpoint 92. The cover 76 overlays the ball 70, opening 72 and groove 75 as shown in FIG. 10. The cover 76 holds the ball 70 against the ribs 94 and a portion of the tapered surface 84.

After the ink is loaded and the cover 76 adhered, there is still air inside the cartridge 40. Because the cartridge is turned bottom side up during filling and sealing, the air is located at the upper most portions of the cartridge 40 (for such bottom side-up orientation). The cartridge 40 then is rotated in a direction 105 to wet the bubble generator 60.

Next, the accumulator 44 air bags are preloaded. Specifically, air is introduced through vent 21 into the accumulator to partially fill the bags with air. In some embodiments the accumulators are not of sufficient capacity to displace all air in the reservoir 42, standpipe 66 and printhead nozzles 64. Accordingly, the cartridge is to be primed to remove air within the standpipe and nozzles. It is desired that all air be removed from such locations to avoid sources of later depriming and drooling. Experimentation revealed that cartridges with no ink or only ink prime well and leave no air in the standpipe. However, for cartridges which had both air and ink prior to the priming process, air would remain trapped in the standpipe even after priming. In particular wetting the screen 106 separating the standpipe section 66 from the remainder of the reservoir prior to priming reduced the effectiveness of priming.

According to one aspect of this invention, the standpipe is maintained empty of ink and the screen is maintained dry of ink before the priming process commences. Prior to filling the cartridge with ink, an external liquid is introduced into the nozzles. In one embodiment, deionized water is placed on the printhead 58 and drawn into the nozzles 64 using a low vacuum force. Preferably enough water is introduced to fill the nozzles and adjacent printhead feed channels. Preferably the water does not wet the screen 106. The water provides a temporary seal which prevents air flow through the nozzles. This seal creates an air barrier which also prevents ink from entering the standpipe and prevents a complete wetting of the screen 106 with ink prior to priming.

Once the ink is loaded into the reservoir and the accumulator preloaded, the cartridge is ready for priming. It is believed that ink flow restriction through the non-wetted screen 106 is greater than the water flow restriction in the nozzles. Thus, during priming, air and water escape through the nozzles before the ink breaks through the screen and standpipe all the way into the nozzles 64. Wetting the screen with ink before priming is undesirable because it blocks air from escaping the standpipe section into the main portion of the reservoir. Once wetted with ink, on the other hand, ink readily passes through the screen 106 with little restriction. By preventing wetting out of the screen and preventing an ink path through the screen before priming, ink subsequently is drawn evenly through the standpipe section during priming leaving no trapped air in the standpipe or nozzles. If, however, the screen is fully or partially wetted prior to priming, some nozzles also may receive ink before priming. A resulting path of least resistance would then occur during priming causing ink to flow around the trapped air reducing the effectiveness of the priming process.

Referring to FIG. 11 air is shown in the cartridge standpipe section 66. As described above, the step of priming is preferably performed on a cartridge 40 that has not yet been turned in a manner that would wet the screen 106. With the cartridge 40 oriented as shown in FIG. 11 (angled at approximately 30°) a pocket of air A remains in the standpipe section 66. An evacuating source 108 then is placed into contact with the printhead 58 over the nozzle orifices. The source 108 sucks the air A (and in some embodiment water) from the cartridge through the nozzles 64. Because the screen 106 is not wet at the beginning of the priming process, there is less resistance at the screen to draw air A' from the main portion of the reservoir 42. As the air A and A' is withdrawn, ink I is pulled evenly into the standpipe section 66 and through printhead channels to the nozzles 64, thus priming the printhead 58 for operation. The evacuating source 108 then is removed, and the cartridge 40 is ready for operation.

There are several advantages achieved by filling the cartridge from the bottom rather than from the top. One advantage is that ink is more evenly distributed within the reservoir 42. The accumulator 44 within the reservoir includes multiple bags which fill with air. During a top-filling process, ink tends to fill unevenly between the bags being at times analogous to the filling of an ice cube tray where one portion is filled until the ink/water spills over to the next portion to fill such other portion.

Another advantage of bottom filling the inkjet cartridge is that priming becomes easier. When filling the cartridge from the top, ink travels down toward the screen 106 and standpipe 66. As a result the screen 106 gets wet with ink during filling. As a result, there is more resistance at the screen 106 when sucking air from the cartridge (i.e., priming the cartridge) through the printhead nozzles 64. Priming of the printhead is more uniform because of the absence of air.

Referring to FIG. 12, according to another aspect of the invention, a single piece of tape 120 or covering is applied over the printhead nozzles 64 and bubble generator vent 78 after priming. This prevents a user from inadvertently placing the cartridge 40 into service with the bubble generator vent 78 blocked. A beneficial effect of using a single covering during shipment for the nozzles 64 and vent opening 78 is that one cause of depriming (i.e., leaving bubble generator vent covered) is avoided.

According to another aspect of the invention, the inkjet cartridge 40 is refilled by removing the bubble generator cover 76 and removing the ball 70 so as to define an open path to the reservoir 42 through the bubble generator's cylindrical opening 72 (see FIG. 9). Ink I is poured into the reservoir 42 through the opening 72. The ball 70 then is re-inserted, and the same cover 76 re-applied or a new cover 76 adhesively attached. In some refill method embodiments the cartridge 40 then is primed, and thereafter is ready for use. In other embodiments priming after a refill is not performed. If the cartridge 40 is to be shipped before use, a tape covering 120 is applied over the printhead nozzles 64 and bubble generator vent opening 78 as shown in FIG. 12.

What is claimed is:

1. A method for filling an inkjet cartridge having an internal reservoir with ink, the cartridge having a printhead defining a plurality of nozzle orifices through which ink is ejected, the cartridge having no openings communicating between an ink-filled area of the reservoir and an external environment other than via the nozzle orifices and an opening of a bubble generator, wherein the bubble generator opening and the printhead orifices occur at a bottom portion of the cartridge, the bubble generator for maintaining back pressure within the internal reservoir and including an object positioned within the bubble generator opening, the method comprising the steps of:

removing the object from the bubble generator opening;

turning the bottom portion of the cartridge away from a bottom side down orientation;

introducing ink into the reservoir through the bubble generator opening;

reinserting the object into the bubble generator opening; and attaching a cover to the bubble generator.

2. A method for filling an inkjet cartridge having an internal reservoir with ink, the cartridge having a printhead defining a plurality of nozzle orifices through which ink is ejected, the cartridge having no openings communicating between an ink-filled area of the reservoir and an external environment other than via the nozzle orifices and an opening of a bubble generator, wherein the bubble generator opening and the printhead orifices occur at a bottom portion of the cartridge, the method comprising the steps of:

turning the bottom portion of the cartridge away from a bottom side down orientation;

introducing ink into the reservoir through the bubble generator opening;

attaching a cover to the bubble generator, in which the cover defines a vent opening for the bubble generator; and applying a single piece of tape in common over the plurality of nozzles and said vent opening prior to operation for preventing inadvertent operation of the cartridge with the vent opening covered, and avoiding said inadvertent operation as a source of depriming the cartridge.

3. A method for refilling an inkjet cartridge having an internal reservoir with ink, the cartridge having a printhead defining a plurality of nozzle orifices through which ink is ejected, the cartridge having no openings communicating between an ink-filled area of the reservoir and an external environment other than via the nozzle orifices and an opening of a bubble generator, wherein the bubble generator opening and the printhead orifices occur at a bottom portion of the cartridge, the method comprising the steps of:

turning the bottom portion of the cartridge away from a bottom side down orientation;

removing the cover from a region of the cartridge including the bubble generator;

removing a bubble generator object from the bubble generator opening, the bubble generator opening in communication with the reservoir;

introducing ink into the reservoir through the bubble generator opening;

inserting a bubble generator obiect into the bubble generator opening; and attaching a cover to the bubble generator.

4. A method for filling an inkjet cartridge having an internal reservoir with ink, the cartridge having a printhead defining a plurality of nozzle orifices through which ink is ejected, the cartridge having no openings communicating between an ink-filled area of the reservoir and an external environment other than via the nozzle orifices and an opening of a bubble generator, wherein the bubble generator opening and the printhead orifices occur at a bottom portion of the cartridge, in which the inkjet cartridge includes an accumulator for regulating pressure in the reservoir, the inkjet cartridge also including a standpipe section along the bottom portion, the printhead being positioned at one end of the standpipe, an opposite other end of the standpipe in communication with the reservoir via a screen, the method comprising the steps of:

turning the bottom portion of the cartridge away from a bottom side down orientation;

introducing ink into the reservoir through a bubble generator opening, wherein said screen is not wetted with ink during said step of introducing ink;

attaching a cover to the bubble generator; and priming the inkjet cartridge, the priming step comprising the following steps:

preloading the accumulator with air;

partially rotating the cartridge to wet the object with ink without wetting the screen with ink; and evacuating air from the standpipe section via a plurality of nozzle orifices.

5. The method of claim 4, further comprising, prior to the step of introducing ink, the step of introducing an external liquid into the printhead nozzles to restrict air flow through the nozzles.

6. The method of claim 4 wherein said external liquid does not wet the screen during said step of introducing the external liquid.

* * * * *